US010858951B2

(12) United States Patent
Hasegawa et al.

(10) Patent No.: US 10,858,951 B2
(45) Date of Patent: Dec. 8, 2020

(54) TURBO COMPRESSOR AND TURBO CHILLER USING SAME

(71) Applicant: MITSUBISHI HEAVY INDUSTRIES THERMAL SYSTEMS, LTD., Tokyo (JP)

(72) Inventors: Yasushi Hasegawa, Tokyo (JP); Kenji Ueda, Tokyo (JP); Akimasa Yokoyama, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 360 days.

(21) Appl. No.: 14/784,821

(22) PCT Filed: Apr. 9, 2014

(86) PCT No.: PCT/JP2014/060329
§ 371 (c)(1),
(2) Date: Oct. 15, 2015

(87) PCT Pub. No.: WO2014/192434
PCT Pub. Date: Dec. 4, 2014

(65) Prior Publication Data

US 2016/0061210 A1 Mar. 3, 2016

(30) Foreign Application Priority Data

May 30, 2013 (JP) ..... 2013-114377

(51) Int. Cl.
*F01D 11/20* (2006.01)
*F04D 29/058* (2006.01)
(Continued)

(52) U.S. Cl.
CPC ..... *F01D 11/20* (2013.01); *F04D 29/041* (2013.01); *F04D 29/042* (2013.01);
(Continued)

(58) Field of Classification Search
CPC .... F04D 29/041; F04D 29/051; F04D 29/048; F04D 29/058; F04D 29/042; F04D 29/052; F01D 11/20
See application file for complete search history.

(56) References Cited

U.S. PATENT DOCUMENTS 2,584,899 A * 2/1952 McLeod ..... F01D 9/041 384/313
4,459,082 A * 7/1984 Niggemann ..... F01D 11/025 415/14
(Continued)

FOREIGN PATENT DOCUMENTS

CN 101248316 A 8/2008
CN 101793269 A 8/2010
(Continued)

OTHER PUBLICATIONS

Decision to Grant a Patent dated Jan. 10, 2017, for Japanese Application No. 2013-114377.
(Continued)

*Primary Examiner* — Christopher S Bobish
(74) *Attorney, Agent, or Firm* — Birch, Stewart, Kolasch & Birch, LLP.

(57) ABSTRACT

The purpose of the present invention is to provide: a turbo compressor which is provided with an open impeller and has the minimal gap between the shroud and the impeller such that efficiency is improved and the safe operating region is enlarged; and a turbo chiller using the same. The turbo compressor is provided with an open impeller with a shroud provided on the side of a casing, and the rotary shaft is supported by a radial magnetic bearing and a magnetic thrust bearing. The turbo compressor is provided with a control unit that comprises: a load calculating means that calculates the axial thrust load generated by the pressure distribution of the compressor; and an axial support position control means
(Continued)

that controls a gap between the impeller and the shroud to be a target gap by varying, on the basis of the axial thrust load, the axial support position of the rotary shaft due to the magnetic thrust bearing.

14 Claims, 3 Drawing Sheets

(51) Int. Cl.

| | |
|---|---|
| ***F04D 29/051*** | (2006.01) |
| ***F04D 29/46*** | (2006.01) |
| ***F04D 29/048*** | (2006.01) |
| ***F04D 29/041*** | (2006.01) |
| ***F04D 29/042*** | (2006.01) |
| ***F04D 29/052*** | (2006.01) |

(52) U.S. Cl.
CPC ..... *F04D 29/048* (2013.01); *F04D 29/051* (2013.01); *F04D 29/052* (2013.01); *F04D 29/058* (2013.01); *F04D 29/462* (2013.01)

(56) References Cited

U.S. PATENT DOCUMENTS

| | | | | |
|---|---|---|---|---|
| 4,999,991 | A * | 3/1991 | Haddad | F01D 11/24 415/178 |
| 5,312,225 | A | 5/1994 | Lorenzen | |
| 5,312,226 | A * | 5/1994 | Miura | F16C 39/06 310/90.5 |
| 6,272,422 | B2 * | 8/2001 | Khalid | F01D 11/14 701/100 |
| 6,487,491 | B1 * | 11/2002 | Karpman | F01D 11/24 415/115 |
| 6,581,399 | B2 * | 6/2003 | Benedict | F04D 27/0284 62/228.1 |
| 7,853,427 | B2 * | 12/2010 | Chan | G01B 7/14 702/158 |
| 7,963,748 | B2 * | 6/2011 | Taniguchi | F04D 27/001 417/18 |
| 7,964,982 | B2 * | 6/2011 | Bosen | F01D 15/10 290/52 |
| 2008/0115527 | A1 * | 5/2008 | Doty | F04D 25/0606 62/498 |
| 2009/0260388 | A1 * | 10/2009 | Nakazeki | F16C 19/54 62/402 |
| 2013/0022442 | A1 * | 1/2013 | Nanukuttan | F01D 11/22 415/1 |
| 2013/0101391 | A1 * | 4/2013 | Szwedowicz | F01D 11/00 415/12 |
| 2014/0023534 | A1 * | 1/2014 | Ramdane | F04D 29/051 417/420 |
| 2014/0216087 | A1 | 8/2014 | Sishtla | |
| 2015/0169811 | A1 * | 6/2015 | Turnquist | G06F 17/5018 703/2 |

FOREIGN PATENT DOCUMENTS

| | | | |
|---|---|---|---|
| CN | 101946095 | A | 1/2011 |
| CN | 102384106 | A | 3/2012 |
| JP | 5-223090 | A | 8/1993 |
| JP | 6-288384 | A | 10/1994 |
| JP | 7-83193 | A | 3/1995 |
| JP | 2755714 | B2 | 5/1998 |
| JP | 2809346 | B2 | 10/1998 |
| JP | 2001-141329 | A | 5/2001 |
| JP | 2009-236063 | A | 10/2009 |
| JP | 2012-42416 | A | 3/2012 |
| WO | WO 2010/124350 | A1 | 11/2010 |
| WO | WO 2013/012491 | A1 | 1/2013 |

OTHER PUBLICATIONS

Japanese Office Action, dated May 10, 2016, for Japanese Application No. 2013-114377, together with an English translation thereof.
International Search Report, issued in PCT/JP2014/060329, dated Jun. 24, 2014.
Written Opinion of the International Searching Authority, issued in PCT/JP2014/060329, dated Jun. 24, 2014.
Extended European Search Report dated Feb. 1, 2016 issued in corresponding European Patent Application No. 14 803 573.6.
Office Action dated Aug. 16, 2016 in corresponding Chinese Application No. 201480021533.6 with an English Translation.

* cited by examiner

TURBO COMPRESSOR AND TURBO CHILLER USING SAME

TECHNICAL FIELD

The present invention relates to a turbo compressor which includes an open impeller and a rotary shaft supported by a magnetic bearing, and a turbo chiller using the same.

BACKGROUND ART

As a turbo compressor applied to a turbo chiller, a turbo compressor having a rotary shaft supported by a magnetic bearing has been hitherto known. In PTL 1, it is disclosed that a rotary shaft is supported by a radial magnetic bearing and a thrust magnetic bearing, the rotary shaft is provided with a balance piston, and a thrust force applied to the thrust magnetic bearing is reduced by increasing and reducing a high pressure introduced into a piston chamber, thereby reducing the size of the thrust magnetic bearing. In addition, in PTL 2, it is disclosed that when a current value supplied to a thrust magnetic bearing reaches a current value corresponding to an allowable maximum load, the opening of an inlet vane is narrowed.

Furthermore, in PTL 3, it is disclosed that a bypass circuit in which a portion of a refrigerant gas compressed by a first-stage impeller is bypassed to be used for cooling a motor and after cooling the motor, is returned to a suction side of a second-stage impeller is provided, and a thrust force applied to the thrust magnetic bearing is reduced by a pressure difference in the refrigerant gas. In PTL 4, it is disclosed that a thrust direction displacement sensor is provided on the rear surface of an impeller, and displacement of a rotary shaft in the thrust direction is detected by the sensor to control the suction force of a thrust magnetic bearing using the output signal thereof.

CITATION LIST

Patent Literature

[PTL 1] Japanese Patent No. 2755714

[PTL 2] Japanese Patent No. 2809346

[PTL 3] Japanese Unexamined Patent Application Publication No. 5-223090

[PTL 4] Japanese Unexamined Patent Application Publication No. 7-83193

SUMMARY OF INVENTION

Technical Problem

In a turbo compressor having an open impeller with a shroud provided on a casing side, in a case where a rotary shaft is supported by a magnetic bearing, the bearing stiffness is lower than those of rolling-element bearings and slide bearings, and the bearing gap (maximum movable gap) is large. Therefore, by increasing a gap between the impeller and the shroud or a seal gap, the risk of performance degradation or initiation of damage due to an increase in a tip clearance caused by contact between the impeller and the shroud is avoided. Particularly, when the bearing stiffness is low, if the bearing load is rapidly changed during the start-up or stop of the compressor, a change in load, or the like, and a change amount of the rotary shaft is increased, and thus the risk of performance degradation or damage due town increase in the tip clearance caused by contact between the impeller and the shroud is increased. Therefore, by predicting this situation, there is a tendency to increase the gap in advance.

On the other hand, in the turbo compressor, in order to achieve performance enhancement by reducing energy consumption and increasing efficiency, there is a need to reduce the gap to reduce gas leakage. In order to cope with the conflicting problems regarding the gap between the impeller and the shroud, how to minimize the gap while avoiding contact between the impeller and the shroud becomes a problem.

The present invention has been made taking the foregoing circumstances into consideration, and an object thereof is to provide a turbo compressor which achieves an increase in efficiency by, in the turbo compressor provided with an open impeller, minimizing a gap between a shroud and the impeller during operation and in the enlargement of a safe operation region in which contact between the impeller and the shroud does not occur, and a turbo chiller using the same.

Solution to Problem

In order to solve the problem, the turbo compressor of the present invention and the turbo chiller using the same employ the following means.

According to a first aspect of the present invention, a turbo compressor includes: an open impeller with a shroud provided on a casing side; a rotary shaft which is supported by a radial magnetic bearing and a thrust magnetic bearing; and a controller which includes load calculating means for calculating an axial thrust load generated by a pressure distribution of the compressor, and axial support position controlling means for controlling a gap between the impeller and the shroud to a target gap by changing an axial support position of the rotary shaft determined by the thrust magnetic bearing on the basis of the axial thrust load.

In this configuration, the axial thrust load which is generated by the pressure distribution of the compressor and is changed depending on the operation state is calculated by the load calculating means on the basis of the measurement values of pressures such as a suction pressure and a discharge pressure of the compressor, or temperatures, and current values distributed and supplied to the thrust magnetic bearing are controlled by the axial support position controlling means on the basis of the values. Accordingly, the axial support position of the rotary shaft determined by the thrust magnetic bearing is changed and thus the gap between the impeller and the shroud is controlled to be the target gap, thereby controlling the gap therebetween to be the minimum gap that allows an operation while avoiding contact therebetween. Therefore, compressed gas leakage from the gaps is reduced and thus compression efficiency is increased by minimizing the gaps between the impeller and the shroud. Accordingly, the performance of the turbo compressor can be enhanced, and a safe operation region can be enlarged.

In the first aspect, the axial support position controlling means may have a function of, when an operation condition in which the axial thrust load is rapidly changed is detected, correcting and controlling the axial support position of the rotary shaft determined by the thrust magnetic bearing to a position where the gap between the impeller and the shroud becomes a gap that is greater than the target gap regarding contact between the impeller and the shroud.

In this configuration, when a transient operation condition in which the axial thrust load is rapidly changed is detected by the axial support position controlling means, an operation can be performed by correcting the gap between the impeller and the shroud can to be the minimum gap that allows the operation while avoiding contact therebetween, that is, the gap which is greater than the target gap. Accordingly, during the transient operation of the compressor, the turbo compressor is operated while preferentially avoiding contact between the impeller and the shroud and thus the risk of performance degradation or damage due to contact is reduced, resulting in the enlargement of a safe operation region.

Furthermore, in the first aspect, the controller may include first correcting means for, in a case where means for detecting an axial position of the rotary shaft is installed at a position distant from a compression section, detecting a temperature of a desired part, calculating a change amount of the gap between the impeller and the shroud from an axial length change amount of the rotary shaft due to thermal expansion and an axial direction change amount of the casing which sets a relative positional relationship between the shroud and the impeller, and on the basis of this, correcting the axial support position.

In this configuration, in a case where the means for detecting the axial position of the rotary shaft is a gap sensor provided at an end portion of the rotary shaft on a side opposite to the compressor between a thrust disk and the thrust magnetic bearing, although thermal expansion of the rotary shaft and the casing has an effect on the control of the gap between the impeller and the shroud, the first correcting means detects the temperature of the rotary shaft or the temperatures of desired parts including the bearing that supports the rotary shaft, the casing, and the like, calculates the axial length change amount of the rotary shaft, and on the basis of this, corrects the axial support position of the rotary shaft. Therefore, the gap between the impeller and the shroud can be appropriately controlled regardless of the installation position of the means for detecting the axial position of the rotary shaft. Therefore, the degree of freedom of the installation positions of the detecting means can be ensured.

Furthermore, in the first aspect, the controller may include second correcting means for correcting the axial support position of the rotary shaft, by calculating the axial thrust load by detecting a change in a load and/or a change in a cooling water temperature, or on the basis of a correlation function set in advance.

In this configuration, the axial support position of the rotary shaft is corrected by the second correcting means by calculating the axial thrust load from the detected change in load which is the direct cause of the rapid change in the axial thrust load (in a case of a chiller, a change in the cold water inlet temperature) and/or the change in the cooling water inlet temperature or on the basis of the correlation function set in advance, thereby setting the gap between the impeller and the shroud to the gap which is greater than the target gap which is the minimum gap that allows the operation while avoiding contact therebetween. Therefore, the gap between the impeller and the shroud can be rapidly controlled to be the gap which is greater than the target gap, and thus contact between the impeller and the shroud can be reliably avoided and a safe operation can be achieved.

Furthermore, in the first aspect, the controller may include third correcting means for correcting the axial support position of the rotary shaft by using a change in a control amount of an opening of an inlet vane of the compressor and/or a change in a rotation frequency control amount of the impeller.

In this configuration, although the opening of the inlet vane of the compressor and the rotation frequency of the impeller (the rotation frequency of the compressor) are changed according to a change in the load and a change in the cooling water temperature, the axial support position of the rotary shaft is corrected by the third correcting means using the changes in the control amounts thereof, and thus the gap between the impeller and the shroud can be controlled to be the gap which is greater than the minimum gap that enables the avoidance of contact therebetween. In this case, a load that moves the axial position is applied simultaneously with the change in the control amounts, the axial support position of the rotary shaft can be corrected without delay. Therefore, the gap between the impeller and the shroud can be rapidly controlled to be the gap which is greater than the minimum gap regarding contact therebetween, and thus contact between the impeller and the shroud can be reliably avoided and a safe operation can be achieved.

Furthermore, in the first aspect, a second gap sensor which detects the axial position from a rear surface thereof may be provided in a position of an outer diameter side of the rear surface of the impeller in addition to a gap sensor which is provided near the rotary shaft and/or the thrust magnetic bearing to detect the axial support position of the rotary shaft, and fourth correcting means for correcting the axial support position of the rotary shaft by using detection signals thereof may be provided.

In this configuration, the deformation of the impeller due to the centrifugal force during high-speed rotation and deformation due to a gas force are detected by the second gap sensor and on the basis of this, the axial support position of the rotary shaft is corrected by the fourth correcting means. Therefore, the gap of the outer diameter side of the impeller can be controlled to be an appropriate gap. That is, an increase in the gap of the outer diameter side of the impeller significantly affects a reduction in performance and an increase in energy consumption and the deformation due to the centrifugal force during high-speed rotation and deformation due to the gas force are significant. Therefore, controlling the gap of the outer diameter side of the impeller to an appropriate gap is effective in suppressing a reduction in the performance of the compressor and an increase in the energy consumption. Accordingly, gas leakage from the gap is reduced and compression efficiency is increased by minimizing the gap between the impeller and the shroud, thereby enhancing the performance of the turbo compressor.

According to a second aspect of the present invention, a turbo chiller includes: a turbo compressor; a condenser; a throttle device; and an evaporator, in which the turbo compressor in the turbo chiller is the turbo compressor in any of the above descriptions.

In this configuration, since the turbo compressor of the turbo chiller including the turbo compressor, the condenser, the throttle device, and the evaporator is the turbo compressor in any of the above descriptions, the compressor which has high efficiency is mounted therein. Therefore, the enhancement of the capability and COP of the turbo chiller and in the enlargement of a safe operation region that does not cause contact between the impeller and the shroud can be achieved. Therefore, the performance of the turbo chiller can be further increased.

Advantageous Effects of Invention

According to the turbo compressor and the turbo chiller of the present invention, the axial thrust load which is generated by the pressure distribution of the compressor and is changed depending on the operation state is calculated by the load calculating means on the basis of the measurement values of pressures such as the suction pressure and the discharge pressure of the compressor or temperatures, and current values distributed and supplied to the thrust magnetic bearing is controlled by the axial support position controlling means on the basis of the values. Accordingly, the axial support position of the rotary shaft determined by the thrust magnetic bearing is changed and thus the gap between the impeller and the shroud is controlled to be the target gap, thereby controlling the gap therebetween to the minimum gap that allows an operation while avoiding contact therebetween. Therefore, compressed gas leakage from the gaps is reduced and thus compression efficiency is increased by minimizing the gaps between the impeller and the shroud. Accordingly, the performance of the turbo compressor can be enhanced, and a safe operation region can be enlarged.

DESCRIPTION OF EMBODIMENTS

Hereinafter, an embodiment of the present invention will be described with reference to FIGS. 1 to 3.

Figure 1:
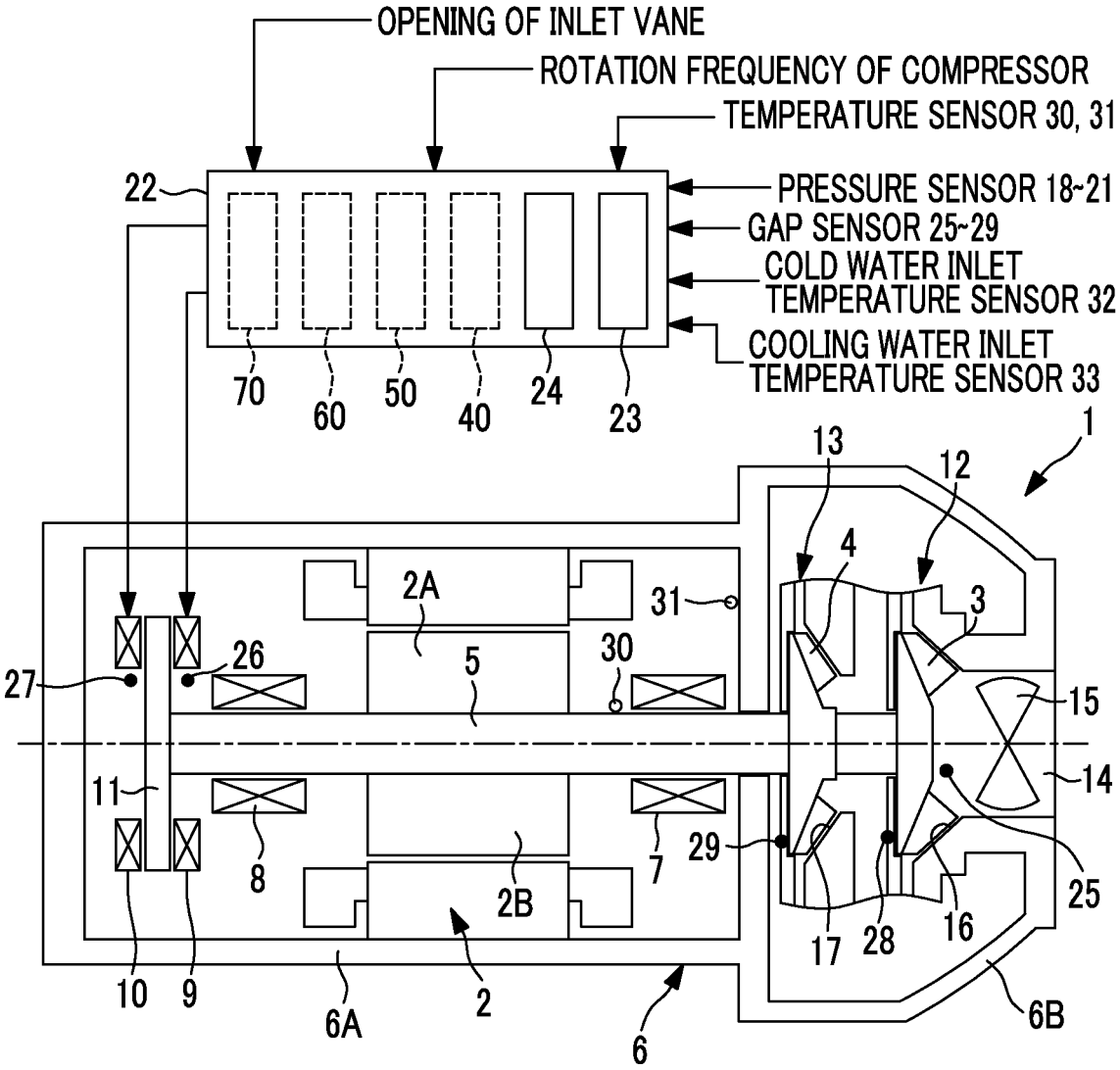
FIG. 1 is a diagram of the overall configuration of a turbo compressor according to an embodiment of the present invention.

FIG. 1 illustrates a diagram of the overall configuration of a turbo compressor according to an embodiment of the present invention.

A turbo compressor 1 is applied to a turbo chiller, a turbo heat pump, and the like (hereinafter, collectively called a turbo chiller), is included in a well-known refrigeration cycle together with a condenser, a throttle device, and an evaporator, and has a function of compressing a low-pressure refrigerant gas into a high-pressure refrigerant gas so as to be circulated through the refrigeration cycle.

The turbo compressor 1 is a turbo compressor 1 in which a rotary shaft 5 that is rotated by a motor 2 to rotate impellers 3 and 4 in two stages, is supported by a pair of front and rear radial magnetic bearings 7 and 8 provided in a casing 6 and a pair of thrust magnetic bearings 9 and 10 which are disposed to oppose each other. The motor 2 includes a rotor 2A and a stator 2B, is installed to be fixed to the center part of a motor chamber 6A of the casing 6, and has a configuration in which substantially the center portion of the rotary shaft 5 is fixed and connected to the rotor 2A.

A thrust disk 11 is installed to be fixed to the rear end portion of the rotary shaft 5, and the pair of thrust magnetic bearings 9 and 10 are disposed to oppose each other with the thrust disk 11 interposed therebetween via a predetermined gap. The pair of thrust magnetic bearings 9 and 10 are configured so that magnetic attraction is generated by currents supplied to the coils thereof so as to allow the thrust disk 11 to be disposed at the center thereof and thus a thrust load applied on the rotary shaft 5 is supported. Therefore, by adjusting the distribution of the currents supplied to the coils, magnetic attraction of each of the bearings 9 and 10 applied to the thrust disk 11 is controlled. Accordingly, it is possible to control the axial support position of the rotary shaft 5 to an arbitrary position.

In a compression chamber 6B of the casing 6, a two-stage compression mechanism including a low-stage side compression section 12 in which the first-stage impeller (may also be simply referred to as impeller) 3 is disposed and a high-stage side compression section 13 in which the second-stage impeller (may also be simply referred to as impeller) 4 is disposed is embedded, and is configured so that the low-pressure refrigerant gas suctioned from a suction port 14 via an inlet vane 15 is compressed by the low-stage side compression section 12 and the discharged gas is suctioned by the high-stage side compression section 13 and is compressed into the high-pressure refrigerant gas in the two stages. Each of the impellers 3 and 4 is directly connected to the front end side of the rotary shaft 5 and is driven to be rotated by the motor 2.

In addition, the first-stage impeller 3 and the second-stage impeller 4 are so-called open impellers such that shrouds 16 and 17 are separated from the impellers 3 and 4 and are provided on the casing 6 side. The first-stage impeller 3 and the second-stage impeller 4 are disposed so that small gaps S are respectively provided between the impellers 3 and 4 and the shrouds 16 and 17.

In the turbo compressor in which the rotary shaft 5 is supported by the radial magnetic bearings 7 and 8, an auxiliary bearing (radial bearing) which supports the rotary shaft 5 when the radial magnetic bearings 7 and 8 are broken or stopped is provided. However, in this embodiment, the description thereof is omitted.

In the turbo compressor 1 having the configuration in which the rotary shaft 5 is supported by the magnetic bearings 7 to 10, the bearing stiffness is generally lower than those of rolling-element bearings and slide bearings, and the bearing gap (maximum movable gap) is large. Therefore, in order to avoid contact between the impellers 3 and 4 and the shrouds 16 and 17, there is a tendency to set the gaps S between the impellers 3 and 4 and the shrouds 16 and 17 to be large. However, the gaps S affect compressed gas leakage and influence compression efficiency. Therefore, it is preferable that the gaps S are as small as possible. In this embodiment, in order to set the gaps S to be as small as possible, the following configuration is employed.

That is, in this embodiment, an axial thrust load Ft generated by the pressure distribution of the low-stage side compression section 12 and the high-stage side compression section 13 and applied to the rotary shaft 5 is calculated, and the axial support position of the rotary shaft 5 determined by the thrust magnetic bearings 9 and 10 is changed according to the axial thrust load Ft so that the gaps S between the first-stage impeller 3 and the second-stage impeller 4 and the shrouds 16 and 17 are controlled to be a target gap S1 (for example, 0.1 mm). The target gap S1 is set to be the minimum gap of the gaps S between the impellers 3 and 4 and the shrouds 16 and 17 such that an operation can be performed while avoiding contact therebetween.

The axial thrust load Ft of the turbo compressor 1 can be calculated as follows.

Figure 2:
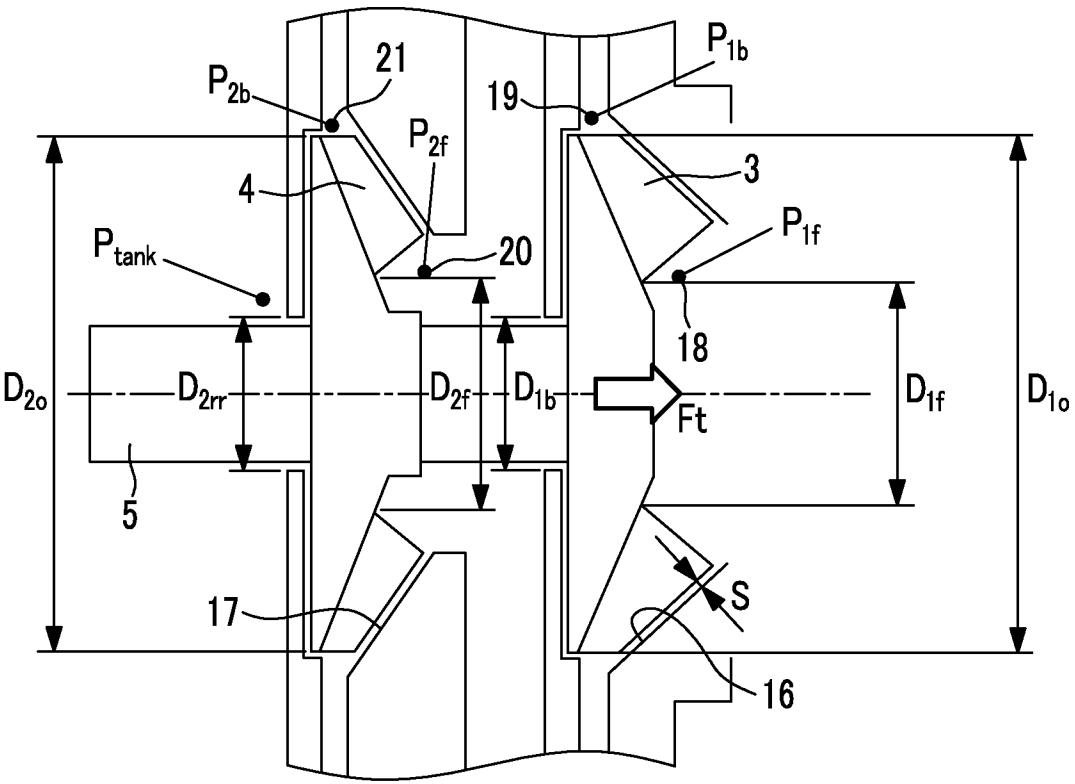
FIG. 2 is a diagram of the configuration of the periphery of impellers of the turbo compressor.

As illustrated in FIG. 2, pressure sensors 18, 19, 20, and 21 are respectively provided on the suction side and the discharge side of the first-stage impeller 3 and the suction side and the discharge side of the second-stage impeller 4, and the detection values thereof are P1f: the suction pressure of the first-stage impeller [MPa], P1b: the discharge pressure of the first-stage impeller [MPa], P2f: the suction pressure of the second-stage impeller [MPa], and P2b: the discharge pressure of the second-stage impeller [MPa].

In addition, when it is assumed that

D1f: the front surface side diameter of the first-stage impeller [mm],

D1o: the outer diameter of the first-stage impeller [mm],

D1b: the rear surface side diameter of the first-stage impeller [mm],

D2f: the front surface side diameter of the second-stage impeller [mm],

D2o: the outer diameter of the second-stage impeller [mm],

D2b: the diameter of the rear surface seal of the second-stage impeller [mm],

F1f: the front surface side thrust load of the first-stage impeller [N],

F1b: the rear surface side thrust load of the first-stage impeller [N],

F2f: the front surface side thrust load of the second-stage impeller [N],

F2b: the rear surface side thrust load of the second-stage impeller [N],

Ft: the axial thrust load [N], and

π: ratio of the circumference or a circle to its diameter, the thrust loads [N] F1f, F1b, F2f, and F2b can be calculated from the following expressions (1) to (4).

$$F1f=[\pi*D1f2*Pvane¼+\pi/2*(D1o-D1f)*\{(P1b-Pvane1)*(D1o3-D1f3)/3+(Pvane1*D1o-P1b*D1f)*(D1o2-D1f2)/2\}]/100*9.80665 \quad (1)$$

$$F1b=\{\pi*P1b*(D1o2-D1b2)/4\}/100*9.80665 \quad (2)$$

$$F2f=[\pi*P1f*(D2f2-D1f2)/4+\pi/2*(D2o-D2f)*\{(P2b-P2f)*(D2o3-D2f3)/3+(P2f*D2o-P2b*D2f)*(D2o2-D2f2)/2\}]/100*9.80665 \quad (3)$$

$$F2b=\{\pi*Ptank*D2rr¾+\pi*P2b/4*(D2o2+D2=2)\}/100*9.8066 \quad (4)$$

Therefore, the axial thrust load [N] Ft of the turbo compressor 1 can be calculated by the following expression (5) as the sum of the expressions (1) to (4).

$$Ft=F1f+F1b+F2f+F2b \quad (5)$$

A controller 22 of the turbo compressor 1 includes load calculating means 23 for calculating the axial thrust load [N] Ft applied to the rotary shaft 5 on the basis of the detection values of the pressure sensors 18, 19, 20, and 21 according to the expressions (1) to (5), and axial support position controlling means 24 for changing the axial support position of the rotary shaft 5 determined by the thrust magnetic bearings 9 and 10 by controlling current values distributed and supplied to the thrust magnetic bearings 9 and 10 on the basis of the calculated values, thereby controlling the gaps S between the impellers 3 and 4 and the shrouds 16 and 17 to the target gap S1. As described above, the target gap S1 is set to be the minimum gap of the gaps S between the impellers 3 and 4 and the shrouds 16 and 17 such that an operation can be performed while avoiding contact therebetween.

In addition, the axial support position controlling means 24 is configured to have a function of, when an operation condition in which the axial thrust load [N] Ft is rapidly changed is detected, that is, in a case where the turbo compressor 1 is determined to be in a transient operation state, controlling and correcting the axial support position of the rotary shaft 5 to a position that forms a gap S2 (for example, 0.2 mm) which is greater than the target gap S1 (0.1 mm) which is the minimum gap of the gaps S between the impellers 3 and 4 and the shrouds 16 and 17 such that an operation can be performed while avoiding contact therebetween.

As the transient operation state, (A) the start-up or stop of the compressor, (B) the occurrence of surging, (C) a change in load, (D) a change in cooling water temperature, (E) a rapid change in rotation frequency, and (F) an abnormal stop of the chiller are postulated. In such an operation state, the axial thrust load Ft is rapidly changed. Therefore, when the operation state is detected, the axial support position controlling means 24 corrects the gaps S between the impellers 3 and 4 and the shrouds 16 and 17 to the gap S2 which is greater than the target gap S1 so as not to allow the impellers 3 and 4 and the shrouds 16 and 17 to come into contact with each other even when the position of the rotary shaft 5 is changed by the rapid change in the axial thrust load Ft.

In this embodiment, during an abnormal stop of the chiller (F), compared to the other transient operation states (A) to (E), the gaps S between the impellers 3 and 4 and the shrouds 16 and 17 is controlled and corrected to a gap S3 which is further greater. That is, in this embodiment, the maximum control width of the axial support position of the rotary shaft 5 is in a range of from a maximum control width (front side) of the shaft to a maximum control width (rear side) of the shaft as illustrated in FIG. 3. At the time of the maximum control width (front side) of the shaft, the gaps S between the impellers 3 and 4 and the shrouds 16 and 17 are set to be the target gap S1, at the time of the maximum control width (rear side) of the shaft, the gaps S between the impellers 3 and 4 and the shrouds 16 and 17 are set to be the maximum gap S3, and halfway therebetween, the gaps S are set to be the gap S2.

In addition, in order to control the gaps S between the impellers 3 and 4 and the shrouds 16 and 17 to the gaps S1, S2, and S3, gap sensors (thrust direction displacement sensors) 25, 26, and 27 which detect the axial support position of the rotary shaft 5 supported by the thrust magnetic bearings 9 and 10 are installed at the front end position of the rotary shaft 5 and the positions of the pair of thrust magnetic bearings 9 and 10. In addition, the gap sensor 25 detects the axial support position of the rotary shaft 5 by directly detecting the front end position thereof, and the gap sensors 26 and 27 detect the axial support position of the rotary shaft 5 from the gaps between the pair of thrust magnetic bearings 9 and 10 and the thrust disk 11.

In addition, in order to enable the control of the gaps, for example, the gap sensors 26 and 27 which detect the gaps between the pair of thrust magnetic bearings 9 and 10 and the thrust disk 11 are both installed at a reference gap of 0.3 mm, and when the gaps S between the impellers 3 and 4 and the shrouds 16 and 17 are controlled to be the target gap S1, the thrust disk 11, that is, the rotary shaft 5 is moved forward by 0.1 mm and is supported at an axial position at which the gap on the front side is 0.2 mm and the gap at the rear side is 0.4 mm.

Similarly, in a case of controlling the gaps S to the gap S2, the thrust disk 11 is supported at a center position at which the gap on the front side is 0.3 mm and the gap on the rear side is 0.3 mm, which is the reference gap. In a case of controlling the gaps S to be the gap S3, the thrust disk 11 is supported at an axial position at which the gap on the front side is 0.4 mm and the gap on the rear side is 0.2 mm. Accordingly, the a stable operation, the gaps S between the impellers 3 and 4 and the shrouds 16 and 17 are controlled to be the target gap S1 (0.1 mm), during the transient operations, the gaps S are controlled to be the gap S2 (0.2 mm) which is greater, and during an abnormal stop which is one of the transient operations, the gaps S are controlled to be the gap S3 (0.3 mm) which is further greater.

Furthermore, in this embodiment, the controller 22 is provided with the following correcting means.

(1) In the above-described embodiment, the gap sensors 26 and 27 as means for detecting the axial position of the rotary shaft 5 are installed at positions distant from the low-stage side compression section 12 and the high-stage side compression section 13. In this case, it is thought that when the gaps S between the impellers 3 and 4 and the shrouds 16 and 17 are controlled, thermal expansion of the rotary shaft 5 has an effect.

Here, correcting means (first correcting means) 40 for detecting the temperature of the rotary shaft 5 or desired parts including the bearing 7 that supports the rotary shaft 5, the casing 6, and the like using temperature sensors 30 and 31, calculating a change amount of a tip clearance gap between the impellers 3 and 4 and the shrouds 16 and 17 from an axial length change amount of the rotary shaft 5 due to thermal expansion and an axial direction change amount of the casing 6 which sets the relative positional relationship between the shrouds 16 and 17 and the impellers 3 and 4, and correcting the axial support position of the rotary shaft 5 on the basis of the calculated values may be provided so that the gaps S can be controlled to be the gaps S1, S2, and S3 by correcting the axial support position of the rotary shaft 5 using the gap sensors 26 and 27.

(2) In addition, in the above-described embodiment, the transient operation state of the turbo compressor 1 is detected by a rapid change in the axial thrust load [N] Ft. However, regarding a change in load and/or a change in the cooling water temperature, correcting means (second correcting means) 50 for correcting the axial support position of the rotary shaft 5 by calculating the axial thrust load [N] Ft using detection values from temperature sensors 32 and 33 which respectively detect a cold water inlet temperature of the evaporator of the turbo chiller and a cooling water inlet temperature of the condenser or on the basis of a correlation function set in advance may be provided so that the gaps S are controlled to be the gap S2 by the second correcting means 50.

(3) Furthermore, since the opening of the inlet vane 15 of the compressor and/or the rotation frequency of the impellers 3 and 4 are controlled in order to control a refrigeration capability according to a change in load or a change in the cooling water temperature, instead of the second correcting means 50, correcting means (third correcting means) 60 for correcting the axial support position of the rotary shaft 5 by using a change in the opening control amount of the inlet vane 15 and a change in the rotation frequency control amount of the impellers 3 and 4 may be provided so that the gaps S are controlled to be the gap S2 by the third correcting means 60.

(4) In addition, in the above-described embodiment, the gap sensors 25, 26, and 27 are installed at the front end position of the rotary shaft 5 and the positions of the pair of thrust magnetic bearings 9 and 10 to detect the axial support position of the rotary shaft 5. However, in addition to this, gap sensors (second gap sensors) 28 and 29 are provided at positions of the outer diameter sides of the rear surfaces of the impellers 3 and 4 to detect the axial position of the rotary shaft 5 from the rear surface sides, and correcting means (fourth correcting means) 70 for correcting the axial support position of the rotary shaft 5 on the basis of the detection signals may be provided to control the gaps S to the gap S2.

As described above, the gaps S are controlled by detecting the deformation amounts of the outer diameter sides of the impellers 3 and 4 because an increase in the gaps S of the outer diameter sides due to the deformation of the blades (impellers) of the impellers 3 and 4 significantly affects a reduction in performance and an increase in energy consumption and the deformation due to the centrifugal force during high-speed rotation of the impellers 3 and 4 and deformation due to the gas force are significant. Therefore, it can be said that controlling the gaps S of the outer diameter sides of the impellers 3 and 4 to an appropriate gap reduces gas leakage and is thus effective in suppressing a reduction in the performance of the compressor 1 and an increase in energy consumption.

In the above-described configuration, according to this embodiment, the following operational effects are exhibited.

As the turbo compressor 1 is operated, the suction pressure and the discharge pressure are applied to the suction side and the discharge side of the first-stage impeller 3 and the second-stage impeller 4, and the axial thrust load Ft directed from the high-pressure side toward the low-pressure side due to the pressure distribution is generated in the direction of arrow illustrated in FIG. 2 and is applied to the rotary shaft 5. The axial thrust load Ft applied to the rotary shaft 5 is supported via the pair of thrust magnetic bearings 9 and 10.

By controlling the distribution of currents supplied to the coils of the thrust magnetic bearings 9 and 10, the axial support position of the thrust disk 11, that is, the rotary shaft 5 is changed, and thus the gaps S between the impellers 3 and 4 and the shrouds 16 and 17 can be controlled. Therefore, as illustrated in FIG. 3, when the thrust disk 11 is positioned at the center position of the maximum control width between the thrust magnetic bearings 9 and 10, the gaps S between the impellers 3 and 4 and the shrouds 16 and 17 can be controlled to be the gap S2 (0.2 mm), when the thrust disk 11 is positioned on the front side of the maximum control width, the gaps S can be controlled to be S1 (0.1 mm), and furthermore, when the thrust disk 11 is positioned on the rear side of the maximum control width, the gaps S can be controlled to be S3 (0.3 mm).

On the other hand, the axial thrust load Ft applied to the rotary shaft 5 can be calculated by the load calculating means 23 of the controller 22 according to the expression (1) to (5) on the basis of the detection values from the pressure sensors 18, 19, 20, and 21 which detect the suction and discharge pressures of the impellers 3 and 4. On the basis of the axial thrust load Ft, when an operation condition in which the thrust load Ft is rapidly changed is detected, the axial support position controlling means 24 determines that the turbo compressor 1 is in the transient operation states of (A) to (E) described above, as illustrated in FIG. 3, allows the thrust disk 11 to be positioned at the center position thereof by the thrust magnetic bearings 9 and 10, and thus causes the gaps S to be S2 such that the turbo compressor 1 can be operated while preferentially avoiding contact between the impellers 3 and 4 and the shrouds 16 and 17.

Figure 3:
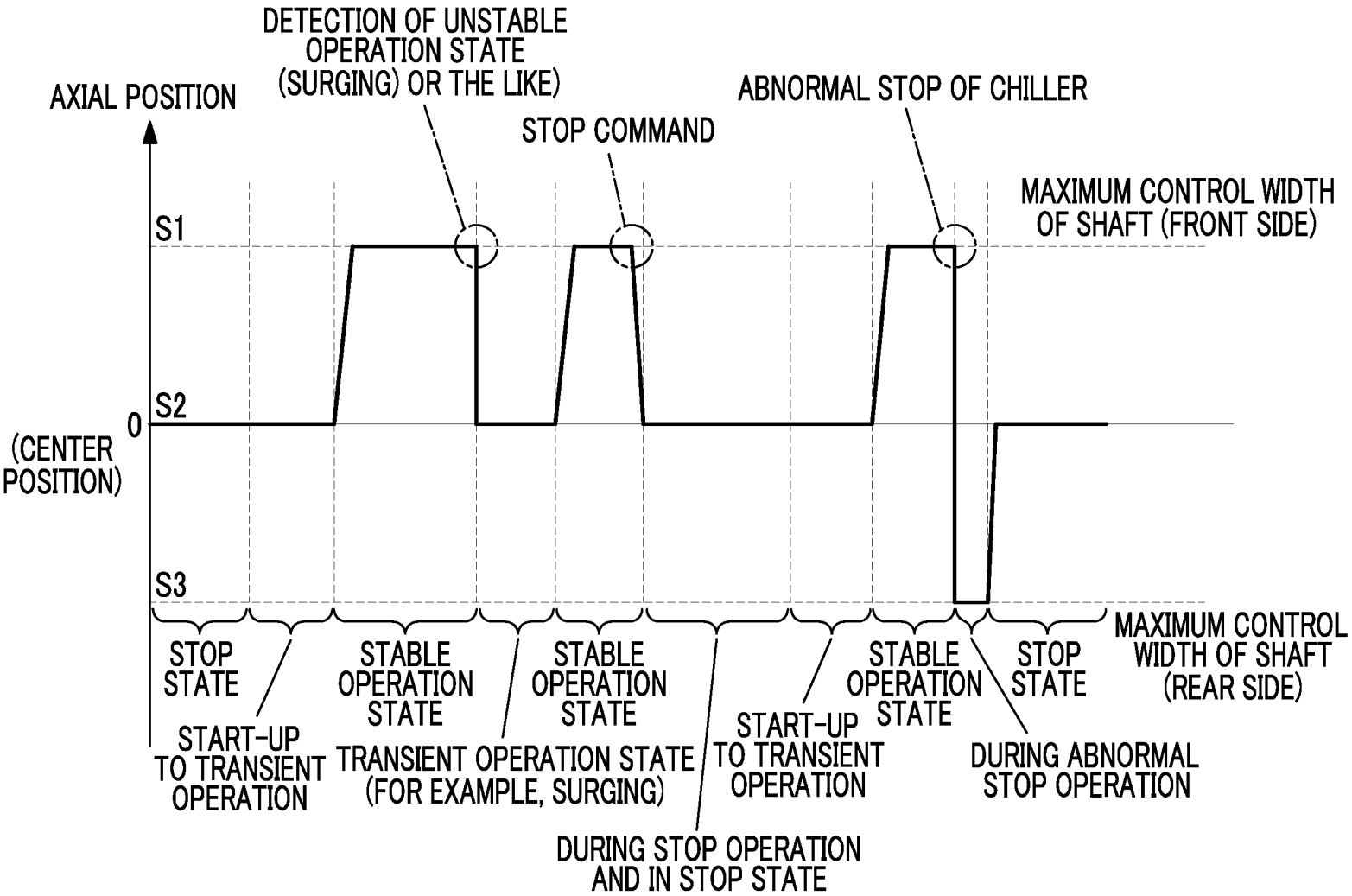
FIG. 3 is a timing chart illustrating an example of dynamic control of the turbo compressor.

FIG. 3 is a timing chart illustrating an example of dynamic control during the operation of the turbo compressor 1. As illustrated in the timing chart, during an abnormal stop of the chiller (F) which is one of the transient operation states, the thrust disk 11 is forced to be positioned on the rear side of the maximum control width so as to control the gaps S to the gap S3 (0.3 mm) which is further greater.

Furthermore, when the axial thrust load Ft is not rapidly changed and is stable, it is determined by the axial support position controlling means 24 that the turbo compressor 1 is in the stable operation state, and the thrust disk 11 is allowed to be positioned on the front side of the maximum control width by the thrust magnetic bearings 9 and 10 so that the turbo compressor 1 can be controlled while the gaps S between the impellers 3 and 4 and the shrouds 16 and 17 are controlled to be the target gap S1 (0.1 mm) which is the minimum gap that allows the operation while avoiding contact therebetween.

In this manner, according to this embodiment, the axial thrust load Ft which is generated by the pressure distribution of the turbo compressor 1 and is changed depending on the operation state is calculated by the load calculating means 23 on the basis of the measurement values of the pressures such as the suction pressure and discharge pressure of the turbo compressor 1, and the current values distributed and supplied to the thrust magnetic bearings 9 and 10 are controlled by the axial support position controlling means 24 on the basis of the values. Accordingly, the axial support position of the rotary shaft 5 determined by the thrust magnetic bearings 9 and 10 is changed and thus the gaps S between the impellers 3 and 4 and the shrouds 16 and 17 is controlled to be the target gap S1, thereby controlling the gaps S to be the minimum gap (the target gap S1) that allows the operation while avoiding contact therebetween.

Therefore, compressed gas leakage from the gaps S is reduced and thus compression efficiency is increased by minimizing the gaps S between the impellers 3 and 4 and the shrouds 16 and 17. Accordingly, the performance of the turbo compressor 1 can be enhanced.

In addition, when the axial support position controlling means 24 has a function of, when an operation condition in which the axial thrust load is rapidly changed is detected, controlling and correcting the axial support position of the rotary shaft 5 determined by the thrust magnetic bearings 9 and 10 to a position at which the gaps S between the impellers 3 and 4 and the shrouds 16 and 17 become the gap S2 which is greater than the target gap S1 regarding the contact therebetween. When a transient operation condition in which the axial thrust load is rapidly changed is detected by the axial support position controlling means 24, the gaps S between the impellers 3 and 4 and the shrouds 16 and 17 can be corrected to be the minimum gap that allows the operation while avoiding contact therebetween, that is, the gap S2 which greater than the target gap S1.

Accordingly, during the transient operation of the turbo compressor 1, the turbo compressor 1 is operated while preferentially avoiding contact between the impellers 3 and 4 and the shrouds 16 and 17 and thus the risk of performance degradation or damage due to the contact is reduced, resulting in the enlargement of a safe operation region.

In addition, as in this embodiment, in a case where the gap sensors 26 and 27 as means for detecting the axial position of the rotary shaft 5 are installed at the positions distant from the compression sections 12 and 13, thermal expansion of the rotary shaft 5 has an effect on the control of the gaps S between the shrouds 16 and 17 and the impellers 3 and 4. However, since the first correcting means 40 is provided in the controller 23 to detect the temperature of the rotary shaft 5 or the temperatures of desired parts including the bearing 7 that supports the rotary shaft 5, the casing 6, and the like, calculate the change amount of the tip clearance gap between the impellers 3 and 4 and the shrouds 16 and 17 from the axial length change amount of the rotary shaft 5 due to thermal expansion and the axial direction change amount of the casing 6 which sets the relative positional relationship between the shrouds 16 and 17 and the impellers 3 and 4, and correct the axial support position of the rotary shaft 5 on the basis of the calculated values, the gaps S between the impellers 3 and 4 and the shrouds 16 and 17 can be appropriately controlled regardless of the installation position of the means for detecting the axial position of the rotary shaft 5. Therefore, a degree of freedom of the installation positions of the gap sensors 26 and 27 as the detecting means can be ensured.

Furthermore, in the controller 22, the second correcting means 50 for correcting the axial support position of the rotary shaft 5 by calculating the axial thrust load Ft from a change in load or a change in the cooling water temperature detected by the cold water inlet temperature sensor 32 and the cooling water inlet temperature sensor 33 or on the basis of the correlation function set in advance is provided so that the axial support position of the rotary shaft 5 is corrected by the second correcting means 50 by calculating the axial thrust load Ft from the detected change in load which is the direct cause of the rapid change in the axial thrust load Ft (in a case of a chiller, a change in the evaporator cold water inlet temperature) and/or the change in the condenser cooling water inlet temperature or on the basis of the correlation function set in advance.

Therefore, during the change in the load and/or the change in the cooling water temperature, the gaps S between the impellers 3 and 4 and the shrouds 16 and 17 can be set to the gap S2 which is greater than the target gap S1 which is the minimum gap that allows the operation while avoiding contact therebetween. Therefore, the gaps S between the impellers 3 and 4 and the shrouds 16 and 17 can be rapidly controlled to be the gap S2 which is greater than the target gap S1, and thus the contact between the impellers 3 and 4 and the shrouds 16 and 17 can be reliably avoided and a safe operation can be achieved.

In addition, in the controller 22, the third correcting means 60 for correcting the axial support position of the rotary shaft 4 by using a change in the opening control amount of the inlet vane 15 of the turbo compressor 1 and a change in the rotation frequency control amount of the impellers 3 and 4 is provided. Therefore, although the opening of the inlet vane 15 of the turbo compressor 1 and the rotation frequency of the impellers 3 and 4 (the rotation frequency of the compressor) are changed according to a change in the load and a change in the cooling water temperature, the axial support position of the rotary shaft 5 is corrected by the third correcting means 60 using the changes in the control amounts thereof, and thus the gaps S between the impellers 3 and 4 and the shrouds 16 and 17 can be controlled to be the gap S2 which is greater than the minimum gap S1 that enables the avoidance of the contact therebetween. In this case, a load that moves the axial position is applied simultaneously with the change in the control amounts, the axial support position of the rotary shaft 5 can be corrected without delay.

Therefore, although the opening of the inlet vane 15 of the turbo compressor 1 and the rotation frequency of the impellers 3 and 4 are changed during a change in the load and a change in the cooling water temperature, the changes in the control amounts thereof are recognized and the gaps S between the impellers 3 and 4 and the shrouds 16 and 17 are rapidly controlled to be the gap S2 which is greater than the minimum gap S1 such that the contact between the impellers 3 and 4 and the shrouds 16 and 17 can be reliably avoided and a safe operation can be achieved.

Furthermore, in this embodiment, in addition to the gap sensors 25, 26, and 27 that are installed near the rotary shaft 5 and/or the thrust magnetic bearings 9 and to detect the axial support position of the rotary shaft 5, the second gap sensors 28 and 29 are provided at the positions of the outer diameter sides of the rear surfaces of the impellers 3 and 4 to detect the axial position from the rear surface sides, and the fourth correcting means 70 for correcting the axial support position of the rotary shaft using the detection signals thereof is provided. Therefore, the deformation due to the centrifugal force during high-speed rotation of the impellers 3 and 4 and deformation due to the gas force are detected by the second gap sensors 28 and 29, and on the basis of this, the axial support position of the rotary shaft 5 is corrected by the fourth correcting means 70. Therefore, the gaps S of the outer diameter sides of the impellers 3 and 4 can be controlled to be an appropriate gap.

That is, an increase in the gaps S of the outer diameter sides of the impellers 3 and 4 significantly affects a reduction in performance and an increase in energy consumption and the deformation due to the centrifugal force during high-speed rotation and deformation due to the gas force are significant. Therefore, controlling the gaps S of the outer diameter sides of the impellers 3 and 4 to be an appropriate gap is effective in suppressing a reduction in the performance of the turbo compressor 1 and an increase in the energy consumption. Accordingly, gas leakage from the gaps S is reduced and compression efficiency is increased by minimizing the gaps S between the impellers 3 and 4 and the shrouds 16 and 17, thereby enhancing the performance of the turbo compressor 1.

In addition, by mounting the turbo compressor 1 which has high efficiency as described above in the turbo chiller, the enhancement of the capability and COP of the turbo chiller and in the enlargement of the safe operation region that does not cause the contact between the impellers 3 and 4 and the shrouds 16 and 17 can be achieved. Therefore, the performance of the turbo chiller can be further increased.

The present invention is not limited to the inventions according to the above-described embodiment, and can be appropriately modified without departing from the spirit of the concept thereof. For example, in the above-described embodiment, an example of a two-stage turbo compressor provided with impellers in two stages is described. However, it is natural that a single-stage turbo compressor or multi-stage turbo compressor having three or more stages may also be similarly applied.

In addition, in the above-described embodiment, an example in which the axial thrust load is calculated by the suction, intermediate suction, and discharge pressures is described. However, as a matter of course, the axial thrust load may be calculated by detecting temperatures and obtaining the saturated pressures thereof.

Furthermore, in the above-described embodiment, an example in which the thrust disk 11 is provided at the rear end of the rotary shaft 5 is described. However, the thrust disk 11 may also be installed to be close to the compression section such as between the motor 2 and the high-stage side compression section 13, and in this case, it is possible to omit the first correcting means 40. In addition, it should be noted that the specific set values S1, S2, S3 of the gaps S between the impellers 3 and 4 and the shrouds 16 and 17 and the specific set values of the gap sensors 26 and 27 exemplified in the above-described embodiment are suppositive set values and are not actual design values.

REFERENCE SIGNS LIST

1 turbo compressor
2 motor
3 first-stage impeller (impeller)
4 second-stage impeller (impeller)
5 rotary shaft
6 casing
7,8 radial magnetic bearing
9,10 thrust magnetic bearing
11 thrust disk
15 inlet vane
16, 17 shroud
18, 19, 20, 21 pressure sensor
22 controller
23 load calculating means
24 axial support position controlling means
25, 26, 27 gap sensor
28, 29 second gap sensor
30, 31 temperature sensor
32 cold water inlet temperature sensor
33 cooling water inlet temperature sensor
40 first correcting means
50 second correcting means
60 third correcting means
70 fourth correcting means
Ft axial thrust load
S gap between impeller and shroud

The invention claimed is:

1. A turbo compressor comprising:
an open impeller with a shroud provided on a casing side;
a rotary shaft which is supported by a radial magnetic bearing and a thrust magnetic bearing; and
a controller configured to
calculate an axial direction thrust load generated by a pressure distribution of the compressor on the basis of a front surface side thrust load and a rear surface side thrust load of the impeller, and
control a gap between the impeller and the shroud to at least two different target gaps including a minimum gap S1 and a gap S2 which is greater than the gap S1 by changing an axial direction support position of the rotary shaft by controlling current values distributed and supplied to the thrust magnetic bearing on the basis of the axial direction thrust load,
wherein the controller, when an operation condition in which the axial direction thrust load is rapidly changed is detected, is configured to correct and control the axial direction support position of the rotary shaft determined by the thrust magnetic bearing from a position where the gap between the impeller and the shroud becomes the minimum target gap S1 to a position where the gap between the impeller and the shroud becomes the second target gap S2 that is greater than the minimum target gap S1 to prevent the impeller from making contact with the shroud due to a position change of the rotary shaft in association with the rapid change in the axial direction thrust load.

2. The turbo compressor according to claim 1,
wherein the controller is further configured to correct the axial direction support position of the rotary shaft, by calculating the axial direction thrust load by detecting a change in a load and/or a change in a cooling water temperature, or on the basis of a correlation function set in advance.

3. The turbo compressor according to claim 1,
wherein one or more sensors include a second gap sensor which is provided at an outer diameter position of the impeller in addition to a gap sensor which is provided near the rotary shaft and/or the thrust magnetic bearing to detect the axial direction support position of the rotary shaft, and said controller is further configured to correct the axial direction support position of the rotary shaft by using detection signals of the second gap sensor.

4. The turbo compressor according to claim 1, wherein the controller is further configured to correct the axial direction support position of the rotary shaft by using a change in a control amount of an opening of an inlet vane of the compressor and/or a change in a rotation frequency control amount of the impeller.

5. The turbo compressor according to claim 1, wherein one or more sensors include a second gap sensor which is provided at an outer diameter position of the impeller in addition to a gap sensor which is provided near the rotary shaft and/or the thrust magnetic bearing to detect the axial direction support position of the rotary shaft, and said controller is further configured to correct the axial direction support position of the rotary shaft by using detection signals of the second gap sensor.

6. The turbo compressor according to claim 1, wherein one or more sensors include a second gap sensor which is provided at an outer diameter position of the impeller in addition to a gap sensor which is provided near the rotary shaft and/or the thrust magnetic bearing to detect the axial direction support position of the rotary shaft, and said controller is further configured to correct the axial direction support position of the rotary shaft by using detection signals of the second gap sensor.

7. The turbo compressor according to claim 1, wherein the controller is further configured to correct the axial direction support position of the rotary shaft, by calculating the axial direction thrust load by detecting a change in a load and/or a change in a cooling water temperature, or on the basis of a correlation function set in advance.

8. The turbo compressor according to claim 1, wherein the controller is further configured to correct the axial direction support position of the rotary shaft by using a change in a control amount of an opening of an inlet vane of the compressor and/or a change in a rotation frequency control amount of the impeller.

9. The turbo compressor according to claim 8, wherein one or more sensors include a second gap sensor which is provided at an outer diameter position of the impeller in addition to a gap sensor which is provided near the rotary shaft and/or the thrust magnetic bearing to detect the axial direction support position of the rotary shaft, and said controller is further configured to correct the axial direction support position of the rotary shaft by using detection signals of the second gap sensor.

10. The turbo compressor according to claim 1, wherein the controller, when one or more sensors to detect an axial direction position of the rotary shaft is installed at a position distant from a compression section, detects a temperature of a desired part including the rotary shaft, the radial magnetic bearing that support the rotary shaft, and the casing, by means of temperature sensors provided in a motor room of the casing, calculates a change amount of the gap between the impeller and the shroud from an axial length change amount of the rotary shaft due to thermal expansion and an axial direction change amount of the casing which sets a relative positional relationship between the shroud and the impeller, and on the basis of this, corrects the axial direction support position.

11. The turbo compressor according to claim 1, wherein an operation condition in which the axial thrust load is rapidly changed is any one of the following:

(A) a start-up or a stop of the compressor, (B) an occurrence of surging, (C) a change in load, (D) a change in cooling water temperature, (E) a rapid change in rotation frequency, and (F) an abnormal stop of a chiller.

12. A turbo chiller comprising:

a turbo compressor;

a condenser;

a throttle device; and an evaporator, wherein the turbo compressor in the turbo chiller is the turbo compressor according to claim 1.

13. A turbo chiller comprising:

a turbo compressor;

a condenser;

a throttle device; and an evaporator, wherein the turbo compressor in the turbo chiller is the turbo compressor according to claim 2.

14. A turbo chiller comprising:

a turbo compressor;

a condenser;

a throttle device; and an evaporator, wherein the turbo compressor in the turbo chiller is the turbo compressor according to claim 4.

* * * * *